United States Patent [19]

Reeve

[11] 4,429,450

[45] Feb. 7, 1984

[54] METHOD OF MAKING STRUCTURAL BEARINGS

[75] Inventor: William E. Reeve, Hemingford Grey, England

[73] Assignee: Dixon International Limited, Cambridge, England

[21] Appl. No.: 410,948

[22] Filed: Aug. 24, 1982

[30] Foreign Application Priority Data

Aug. 26, 1981 [GB] United Kingdom ..... 8126010

[51] Int. Cl.[3] ..... B23P 11/02

[52] U.S. Cl. ..... 29/451; 14/16.1; 156/306.9; 156/307.7; 156/583.1

[58] Field of Search ..... 29/451, 155 R; 14/16.1; 156/307.7, 306.9, 583.1, 306.6, 309.6

[56] References Cited

U.S. PATENT DOCUMENTS

| | | | |
|---|---|---|---|
| 1,595,107 | 8/1926 | Lyng et al. | 156/306.9 X |
| 2,350,887 | 6/1944 | Goff | 156/309.6 X |
| 3,321,813 | 5/1967 | Jansson et al. | 29/451 X |
| 3,484,935 | 12/1969 | Burns | 29/451 X |
| 3,544,176 | 12/1970 | Slater | 14/16.1 X |
| 3,544,415 | 12/1970 | Price et al. | 14/16.1 X |
| 3,701,706 | 10/1972 | Giddings et al. | 156/306.9 X |
| 4,033,005 | 7/1977 | Czernik et al. | 14/16.1 |
| 4,123,815 | 11/1978 | Neff | 14/16.1 |
| 4,290,838 | 9/1981 | Reavill et al. | 156/306.6 X |

FOREIGN PATENT DOCUMENTS

| | | | |
|---|---|---|---|
| 696512 | 10/1964 | Canada | 14/16.1 |
| 738,639 | 7/1966 | Canada | 14/16.1 |
| 883,436 | 11/1961 | United Kingdom | 14/16.1 |
| 1192744 | of 1970 | United Kingdom . | |
| 2054092 | of 1981 | United Kingdom . | |

*Primary Examiner*—Charlie T. Moon

*Attorney, Agent, or Firm*—Shapiro and Shapiro

[57] ABSTRACT

A modular element for a bridge or structural bearing having metal plates encased within layers of vulcanized rubber is formed in a press including a lower member with at least one post or pin extending upwardly through corresponding holes in the metal plates. A vulcanized rubber plug is inserted and retained in each hole in the modular element after it is removed from the press.

5 Claims, 5 Drawing Figures

METHOD OF MAKING STRUCTURAL BEARINGS

TECHNICAL FIELD OF THE INVENTION

The present invention relates to structural bearings. In particular, but not exclusively the invention relates to bridge bearings.

For convenience, the invention is hereinafter described with particular reference to bridge bearings but it is to be understood that the invention is applicable to other structural bearings.

BACKGROUND OF THE INVENTION

Structural bearings are intended to be interposed between a support and a member such as a slab or beam supported thereby. The structural bearing absorbs relative movement between the support and the beam or slab. Such movement may be caused by, for example, temperature changes, curing shrinkage of concrete, or settling of foundations. The movement may be horizontal displacement of the slab or beam and/or rotational movement of the slab or beam about a horizontal axis.

A first known type of bridge bearing is in the form of a monolithic block consisting of a stack of parallel metal plates, which in use of the bearing are horizontal, embedded in rubber. Layers of rubber separate each two adjacent plates and cover the top plate and the bottom plate. Also rubber completely covers the edges of the plates. Thus there are no exposed surface areas of the metal plates and the metal plates are protected against rusting or other corrosion. In use of the bearing the layers of rubber deform to absorb relative movement between the support and the beam or slab and the metal plates resist excessive laterally outwards or horizontal deformation of the rubber. The bearing is manufactured by making a stack of the metal plates and unvulcanized rubber sheets, the rubber sheets being disposed between each pair of adjacent metal plates and below the bottom plate and above the top plate. The stack of metal plates and rubber sheets is then subjected to pressure (applied to the top and bottom of the stack) and to heat to cause the rubber to vulcanize and to cause the rubber to form an integral body containing the metal sheets. Disadvantages of this vulcanization process are that the layers of rubber between the metal plates tend to be of variable uncontrolled thicknesses and it is difficult to ensure that the rubber at the interior of the bearing is satisfactorily vulcanized and the rubber adjacent the exterior of the bearing is not overvulcanized. A further disadvantage is that the vulcanization process has to be carried out slowly to control, as far as possible, the degree of vulcanization throughout the bearing. Consequently the rate of production of the bearing is slow and, in view of the capital cost of the necessary vulcanization equipment, costly. Another disadvantage is that the bridge bearing has to be made as a single unit of the desired size.

The aforementioned disadvantages are overcome or mitigated by a second type of bridge bearing, such as disclosed in British patent specification No. 1,192,744 (originally in the name of Silent Channel Products Limited). This bridge bearing comprises a stack of modular elements, namely an upper modular element, one or more intermediate modular elements and a lower modular element. The or each intermediate element has a layer of rubber adhered to and interposed between two metal plates. The upper element has a layer of rubber on top of and adhered to a metal plate and the lower element similarly has a layer of rubber below and adhered to a metal plate. The plates are provided with holes in which are located circular members such as rings or discs which key together the adjacent metal plates of adjacent elements, each circular member being located in corresponding holes in both of the plates. To prevent relative rotation of each two keyed together plates, it is necessary that at least two of the circular members are used to key together the plates. The layers of rubber overlap the metal plates and extend around and are adhered to the edges of the metal plates but the opposed faces of the metal plates of adjacent elements are free of rubber. Since the edges of the plates are covered by rubber, the metal plates are effectively encased by rubber and protected against corrosion. The elements after manufacture can be assembled into a bridge bearing of the desired height by using a selected number of intermediate elements. However, one disadvantage of the bearing is that moisture can penetrate between adjacent elements and cause corrosion of the metal plates at their surfaces not covered by rubber. Another disadvantage is that when the rubber has a tendency to break away from the edges of the plates when the bearing is under load and the rubber layers are being compressed and deformed laterally and outwardly. Yet another disadvantage is that the exposed metal surfaces of the elements tend to corrode on storage prior to assembly to form the bridge bearing.

The disadvantages referred to above are overcome or mitigated by a third type of bridge bearing disclosed in British patent specification No. 2,054,092A (Dixon International Limited). In this type of bridge bearing, both the upper and lower surfaces and the edge of each metal plate are covered by rubber.

It is normal with bridge bearings of the second and third types to adhere the assembled elements together prior to installation in a bridge structure. The purpose of this is to facilitate handling of the bearing and to prevent the bearing coming apart and the keying members, which are essential, being lost or not replaced in the bearing.

The intermediate elements of the second types of bridge bearing are manufactured by locating the lower metal plate of the element on the bottom mould plate of a press, placing a plurality of sheets of rubber on the lower metal plate, and locating the upper metal plate on the top mould plate of the press, the upper metal plate being held against the top mould plate by magnets. Both the lower and upper metal plates are accurately located by pins on the bottom and top mould plates, respectively mounted on the upper and lower platens of the press, the pins engaging in openings in the plate. The press is then operated to compress the sheets of rubber between the plates and to heat and vulcanize the rubber.

The intermediate element of the third type of bridge bearing is manufactured similarly to the intermediate element of the second type of bridge bearing but, in addition, sheets of rubber are placed between the bottom mould plate and the lower metal plate and between the upper metal plate and the top mould plate.

The upper and lower elements are also manufactured similarly in a press, but only one metal plate is used in each element.

Although in the manufacture of the intermediate elements of both the second and third types of bridge bearings the upper and lower plates can be accurately located, the locating of the upper plate tends to be time consuming. Moreover if the upper plate is curved or otherwise deformed from a planar state, as not infrequently happens, (due to e.g. metal surface treatments, such as shot-blasting, for the purpose of preparing the metal surface to achieve good mechanical bonding with the rubber) the plate cannot be held securely to the upper mould plate by the magnets and may become displaced from its desired position.

Moreover, with both the second and third types of bridge bearing it is necessary to manufacture the upper and lower elements (which may be identical) in addition to the intermediate elements.

DESCRIPTION OF THE INVENTION

This invention aims to overcome the aforementioned disadvantages.

In accordance with the first aspect of the present invention, there is provided a method of manufacturing a modular element for a bridge bearing or other structural bearing comprising: providing a press having relatively movable upper and lower members, the lower member having one or more upstanding posts or pins; positioning on the lower member, successively, one or more rubber sheets, a lower metal plate, one or more rubber sheets, an upper metal plate and one or more rubber sheets, the one or more posts or pins extending through holes in the metal plates and the rubber sheets and locating the metal plates to prevent lateral movement thereof; operating the press to move the upper and lower members together and to subject the rubber sheets to pressure and subjecting the rubber sheets to heat to effect vulcanization of the rubber and to bond the rubber to the metal plates whereby an intermediate layer of rubber is formed between the two plates and the upper and lower layers of rubber are formed respectively above and below the upper and lower plates, the rubber deforming around and bonding to the edges of the metal plates, whereby the plates become completely encased in rubber; removing the resulting modular element from the press; and inserting a vulcanised rubber plug into the or each of the holes left by the one or more posts or pins. Preferably the posts of the lower member of the press and the holes of the metal plates are so relatively dimensioned that a rubber flash is formed around the edges of the holes in the plates and connects the upper and lower layers of rubber with the intermediate layer of rubber between the plates.

Because all surfaces of the metal plates are covered by rubber, an individual modular element prepared by the method of the invention may be used as a bridge bearing. Normally however a plurality of such modular elements would be made into a stack, the adjacent metal plates of adjacent modular elements being keyed together by metal members inserted into the holes of the plates.

The rubber plugs are required in order to prevent stress on the rubber surrounding the holes in the intermediate layer of rubber, in use of the bridge bearing.

The rubber plugs need only be of a thickness equal to that of the intermediate layer of rubber. This leaves the opening in the metal plates free to receive the keying member or a dowel of structural part of a bridge with which the bearing engages. However, where one of the surfaces of the modular element is to engage a structural part of a bridge and be held in position by friction only, the plug preferably is flush with that surface of the modular element.

In a second aspect, the present invention provides a bridge or other building structure having a structural member and support therefor, between the structural member and the support there being interposed a single modular element manufactured by the method of the invention, the modular element being in contact with both the structural member and the support.

In a third aspect, the present invention provides a bridge bearing or other structural bearing comprising a stack of modular elements manufactured by the method of the invention, the modular elements being adhered together ready for installation in a bridge or other building structure, the upper and lower surfaces of the upper and lower modular elements respectively being exposed for contact with respectively a structural member and a support therefor of the structure.

It will be appreciated that modular elements produced by the method according to the invention can be stored indefinitely without corrosion of the metal plates and used singly as structural bearings or assembled when required into structural bearings comprising a desired number of the modular elements.

The invention is further described below by way of example with reference to the accompanying drawings, wherein.

Figure 1:
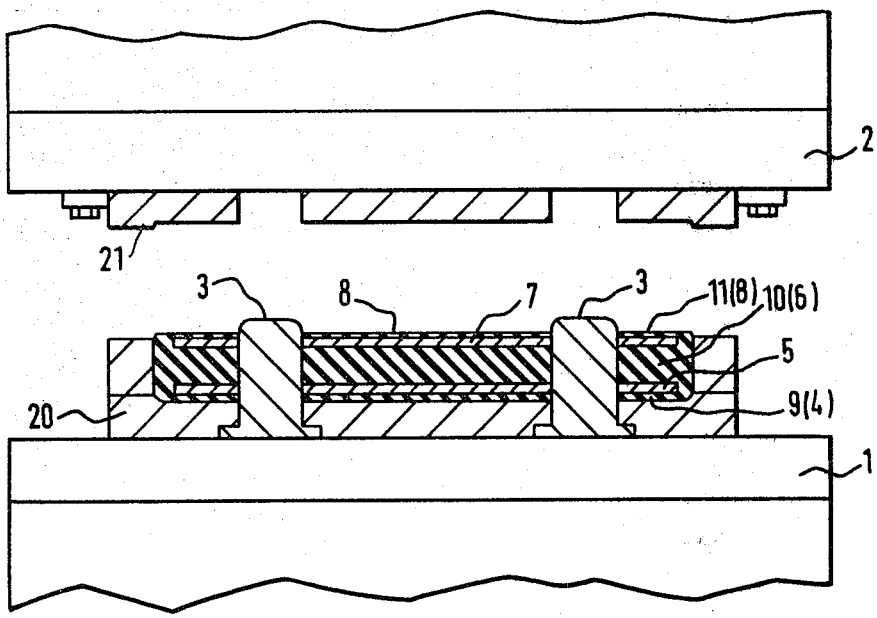
FIG. 1 is a sectional view through a press for use in the process of the invention, and showing a modular element being manufactured.

Referring to the drawings, for manufacturing bridge bearings according to the invention a press (FIG. 1) is provided having a fixed platen 1 and a vertically movable platen 2. Mounted on the platen 1 are the bottom plate 20 of a mould and two upstanding locating posts or pins 3. Mounted on the platen 2 is the top plate 21 of the mould.

In use of the press to manufacture a modular element for a bridge bearing, successively one or more rubber sheets 4, a metal plate 5, a plurality of rubber sheets 6, a metal plate 7 and one or more rubber sheets 8 are placed on the platen 1. The rubber sheets and the plates each have two holes through which fit the posts 3.

The press is then closed, the top platen being brought down so that the top and bottom plates of the mould meet to apply pressure to the rubber sheets and the metal plates, and the platens being heated so that heat is applied to the rubber sheets and the metal plates in order to vulcanize the rubber and cause the rubber to adhere to the metal plates. The rubber sheets are vulcanized together to form a layer of rubber 9 (FIG. 2) below the metal plate 5, a layer of rubber 10 between the metal plates 5 and 7 and a layer of rubber 11 above the metal plate 7. The mould, when closed, defines a mould cavity larger in area than the metal plates 5 and 7 and thus the rubber forms a surround 12 integral with the rubber layers 9, 10 and 11 and covering the edges of the plates. The holes in the metal plates are slightly larger in diameter than the posts 3. Consequently the rubber penetrates into the holes in the plates and forms fillets or a flash (not shown in the drawings) interconnecting the rubber layers 9 and 10 and 11 and covering the edges of the metal plates 5 and 7.

The press is then opened and the element thereby formed is withdrawn. Vulcanized rubber plugs 13 are inserted into the holes in the layer 10. The plugs 13 are a push fit in the holes.

The rubber element thus formed may be used alone as a bridge or other structural bearing. The plugs 13 may be the same thickness as the intermediate rubber layer 12, so that recesses 15 are defined at the top and bottom of the bridge bearing to receive dowels or spigots embedded in the two structural members between which the bearing is located.

A bridge or other structural bearing may alternatively be formed by making a stack of two or more of the modular elements (FIG. 4) with the recess 15 of adjacent elements in register, the modular elements being keyed together by circular metal discs 16 located in the recesses 15, and in particular located in the holes in the metal plates 5 and 7, a single one of the discs being located in each two registering recesses 15. For convenience of transport and handling the modular elements are adhered together.

The bridge bearing is located between two structural members 101 and 102, such as a bridge support and a bridge beam and located by dowels 103 embedded in the structural members and engaged in the recesses 15 at the top and bottom of the bridge bearing.

Figure 2:
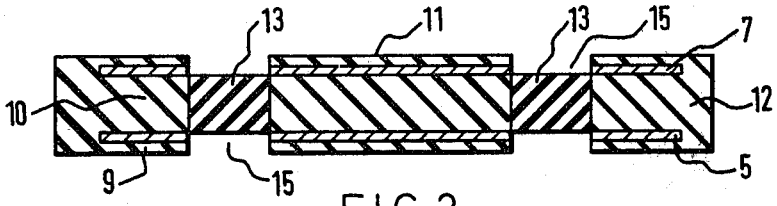
FIG. 2 is a section view of a modular element according to the invention.
Figure 3:
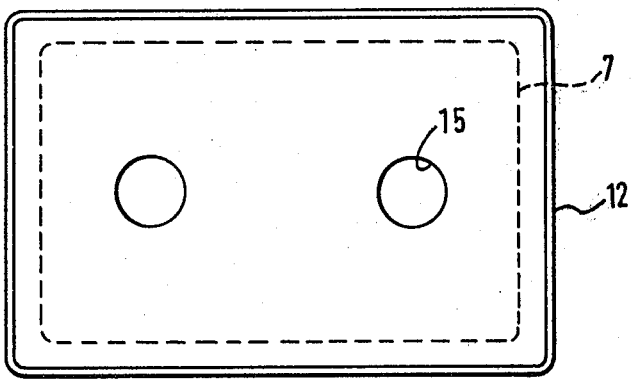
FIG. 3 is a plan view of a modular element according to the invention.

In a modification of the bridge bearing of FIG. 2, the plugs 13 may be of increased thickness and extend to the top and/or bottom face of the bridge bearing. (However, the plugs must be at least coextensive in thickness with the intermediate layer 10 of the bearing). The bridge bearing is then held located, at the relevant face or faces, or the structural member solely by friction, no dowels being used.

Figure 4:
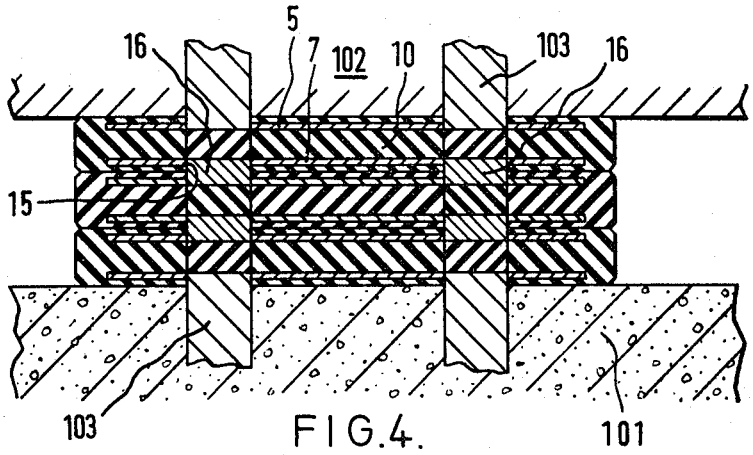
FIG. 4 is a sectional view through a bridge bearing according to the invention.
Figure 5:
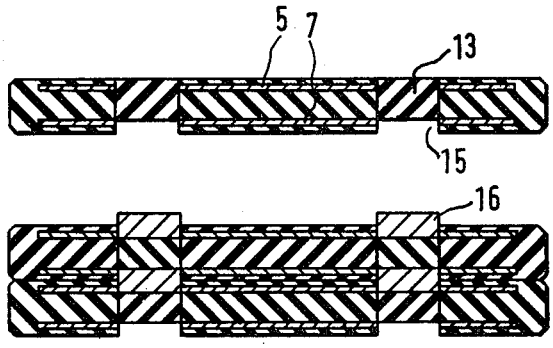
FIG. 5 is a sectional view, partly exploded, of a further bridge bearing according to the invention.

FIG. 5 shows a modification of the bridge bearing of FIG. 4. Referring to FIG. 5, the plugs 13 of the top modular element are of increased thickness and extend to the top face of that element. The bearing is then held located at its top face, with respect to the structural member 102, solely by friction, no dowels being used. Also (although not as shown in FIG. 5) the plugs 13 of the bottom modular element may be of increased thickness and extend to the bottom face of that element. The bridge bearing is then held located on the structural element 101 solely by friction, no dowels being used. In both cases, of course, the plugs 13 must be coextensive in thickness with the intermediate layer 10 of the top and bottom modular elements.

In use of the bridge bearings described above, the plugs 13 are necessary to avoid internal stress around the holes left by the posts 3. Without the plugs 13, the rubber around the holes might split or crack and lose its adherence with the plates 5 and 7.

It will be appreciated that in the modular elements according to the invention described above, the entire surfaces of the netal plates are covered by rubber. Hence the modular elements can be stored indefinitely without corrosion of the metal plates before use as or in bridge bearings and without application of preservative which would need to be subsequently removed. Moreover an individual modular element can be used as a bridge bearing or a plurality of such elements can be assembled into a bridge bearing, the bridge bearing consisting solely of like (substantially identical) modular elements, apart possibly from plugs of increased thickness in the top and/or bottom elements. There is moreover no metal-to-metal contact in the bearings.

In addition, the bridge bearings according to the invention, whether consisting of only one modular element or of a plurality of modular elements comply with B.S.I. Technical Memorandum B 1/76, which requires all metal parts of bridge bearings to be completely encased in rubber.

I claim:

1. A method of manufacturing a modular element for a bridge bearing or other structural bearing comprising: providing a press having relatively movable upper and lower members, the lower member having one or more upstanding posts or pins; positioning on the lower member, successively, one or more rubber sheets, a lower metal plate, one or more rubber sheets, an upper metal plate and one or more rubber sheets, the one or more posts or pins extending through holes in the metal plates and the rubber sheets and locating the metal plates to prevent lateral movement thereof; operating the press to move the upper and lower members together and to subject the rubber sheets to pressure and subjecting the rubber sheets to heat to effect vulcanization of the rubber and to bond the rubber to the metal plates whereby an intermediate layer of rubber is formed between the two metal plates and upper and lower layers of rubber are formed respectively above and below the upper and lower plates, the rubber deforming around and bonding to the edges of the metal plates, whereby the plates become completely encased in rubber; removing the resulting modular element from the press; and inserting a vulcanized rubber plug into the or each of the holes left by the one or more posts or pins and retaining said plug therein.

2. A method according to claim 1, wherein the posts of the lower member of the press and the holes of the metal plate are so relatively dimensioned that a rubber flash is formed around the edges of the holes in the plate and connects the upper and lower layers of rubber with the intermediate layer of rubber between the plates.

3. A method according to claim 1 or 2, wherein the or each rubber plug is of a thickness such that after insertion into the corresponding hole in the modular element the plug is at least co-extensive with the intermediate layer of rubber.

4. A method according to claim 1 or 2, wherein the or each rubber plug leaves, after insertion into the corresponding hole in the modular element, at at least one surface of the modular element, an opening to receive a keying member of a structural part.

5. A method according to claim 1 or 2, wherein the or each rubber plug, after insertion into the corresponding hole in the modular element, is flush with a least one surface of the modular element.

* * * * *